US006014623A

United States Patent [19]

Wu et al.

[11] Patent Number: 6,014,623

[45] Date of Patent: Jan. 11, 2000

[54] METHOD OF ENCODING SYNTHETIC SPEECH

[75] Inventors: Xingjun Wu; Yihe Sun, both of Beijing, China

[73] Assignee: United Microelectronics Corp., Taiwan

[21] Appl. No.: 08/873,803

[22] Filed: Jun. 12, 1997

[51] Int. Cl.[7] ..... G10L 9/00; G10L 9/18

[52] U.S. Cl. ..... 704/230; 704/219; 704/220; 704/222; 704/223

[58] Field of Search ..... 704/230, 219, 704/214, 229, 222, 220, 223

[56] References Cited

U.S. PATENT DOCUMENTS

| | | | |
|---|---|---|---|
| 5,305,421 | 4/1994 | Li | 704/219 |
| 5,699,477 | 12/1997 | McCree | 704/219 |
| 5,732,389 | 3/1998 | Kroon et al. | 704/219 |
| 5,778,338 | 7/1998 | Jacobs et al. | 704/223 |
| 5,794,180 | 8/1998 | McCree | 704/228 |

OTHER PUBLICATIONS

Sadaok et al., "Digital Speech Processing Synthesis and Recognition", pp. 126–133.

*Primary Examiner*—David R. Hudspeth
*Assistant Examiner*—Susan Wieland
*Attorney, Agent, or Firm*—Rabin & Champagne, P.C.

[57] ABSTRACT

A method of synthetic speech, wherein the method forms a speech data base, the speech data base includes plural syllables, each of the syllables having a total frame number of the syllable and plural frame parameters. Each of the frame parameter is formed using an energy amount, a speech pitch period, and 10 Line Spectrum Pair (LSP) speech parameters. Thereafter, each LSP speech parameter is encoded using 4 bit Differential Quantization.

10 Claims, 3 Drawing Sheets

CREATE DATABASE FOR CHINESE SPEECH HAVING 1200 SYLLABLES
202A

ENCODE THE ENERGY AMOUNT (8 BITS)
206A

208A
ENCODE THE SPEECH PITCH PERIOD (7 BITS)

208B
ENCODE THE LSP SPEECH PARAMETERS (7 BITS)

208C
ENCODE THE FRAME PARAMETERS (55 BITS)

ENCODE THE FRAME PARAMETERS TO INCLUDE 10 LSP SPEECH PARAMETERS
208D

METHOD OF ENCODING SYNTHETIC SPEECH

BACKGROUND OF THE INVENTION

1. Field of the Invention

The present invention relates in general to a method of digitally encoding synthetic speech, and more particularly to a Line Spectrum Pair (LSP) scheme that encodes the LSP synthetic speech parameters using Differential Quantization.

2. Description of the Related Art

In the past several years, semiconductor manufacturers have developed many synthetic speech chips for a great number of applications, including toys, personal computers, car electronics, etc. In these chips the PARCOR algorithm and ADPCM algorithm have been widely used. These well known speech analysis-synthesis methods encode the speech parameters with pulse-code modulation (PCM). PCM is a modulation method in which the peak-to-peak amplitude range of the signal to be transmitted is divided into a number of standard values, each value having its own three-place code. Thereafter, each sample of the signal is transmitted as the code for the nearest standard amplitude. The PCM encoding method encodes each speech sample directly, thereby creating a large number of data bits. Therefore, a speech synthesis chip that encodes the speech parameter using the PCM method will have a large device scale.

Another drawback of the PARCOR algorithm is its bit rate limit, wherein below approximately 2,400 bps the synthesized voice becomes unclear and unnatural.

To overcome the disadvantages of the above synthetic speech algorithms, the LSP method was developed. LSP, an improved algorithm derived from PARCOR, requires only 60% of the bit rate required for PARCOR synthesis, yet still maintains the same level of quality. Since the bit rate needed to perform the operations is lower, the resulting tone is improved. See "Digital Speech Processing Synthesis and Recognition", Sadaok & Furnin, ISBN 0-8247-7965-7, pages 126, 133.

SUMMARY OF THE INVENTION

Accordingly, an object of the present invention is to provide an improved method of digitally encoding synthetic speech.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention includes a method of encoding synthetic speech. The method includes receiving input speech including plural syllables; creating a speech data base, wherein the speech data base comprises plural data units that each represent corresponding ones of the plural syllables, each of the plural data units having a total frame number and plural frame parameters; forming each of the plural frame parameters to include an energy amount, a speech pitch period, and plural LSP speech parameters, based on the plural syllables of the input speech; and encoding each of the plural LSP speech parameters using differential quantization. Preferably, creating a speech data base includes creating a data base having data units representing at least 1200 Chinese single syllables. Preferably, forming each of the plural frame parameters includes encoding the energy amount using 8 bits. Preferably, encoding each of the plural LSP speech parameters includes encoding each of the LSP speech parameters using 4 bits, or encoding the speech pitch period using 7 bits, or encoding each of the frame parameters using 55 bits, or encoding each of the frame parameters to include 10 LSP speech parameters. The method may further include retrieving at least some of the plural data units for conversion to corresponding audio signals, comparing the audio signals to corresponding ones of the plural syllables of the input speech, and adjusting the LSP speech parameters based on a result of the comparison.

It is to be understood that both the foregoing general description and the following detailed description are exemplary and explanatory only and are not restrictive of the invention, as claimed.

DESCRIPTION OF THE PREFERRED EMBODIMENT

Figure 1:
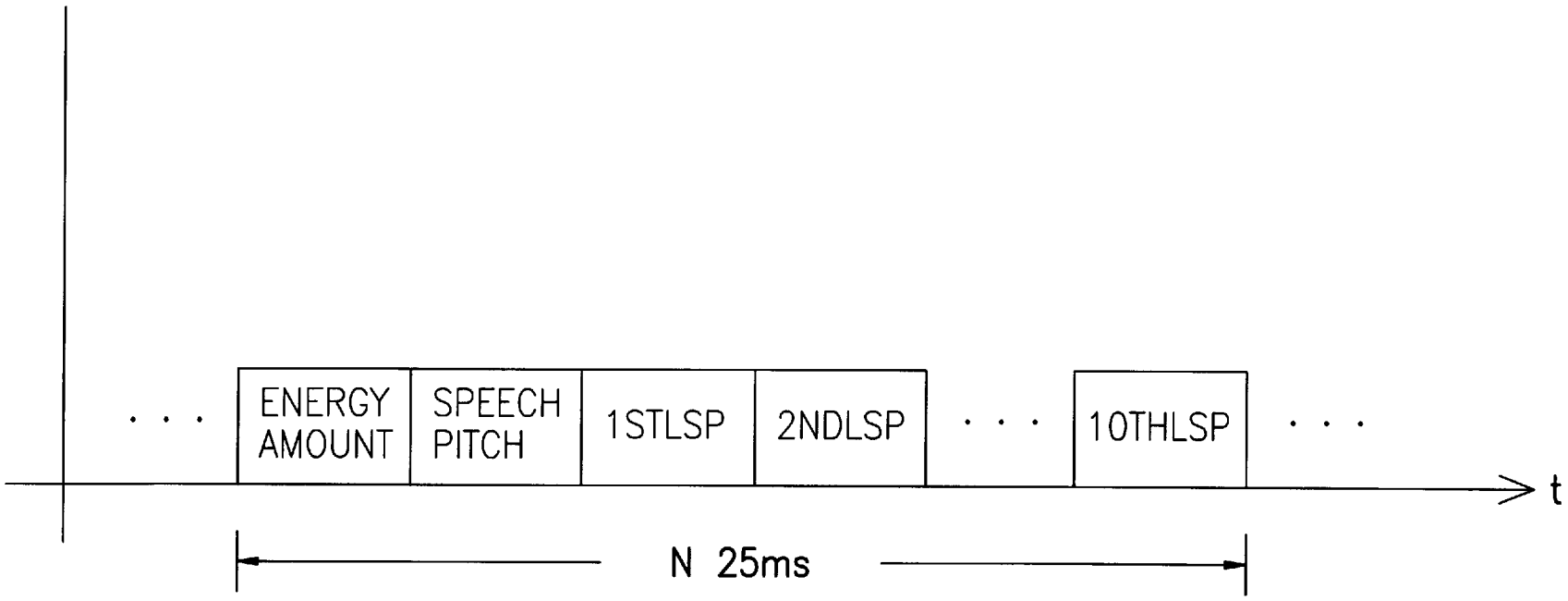
FIG. 1 shows a flow of the method of the invention.
Figure 2:
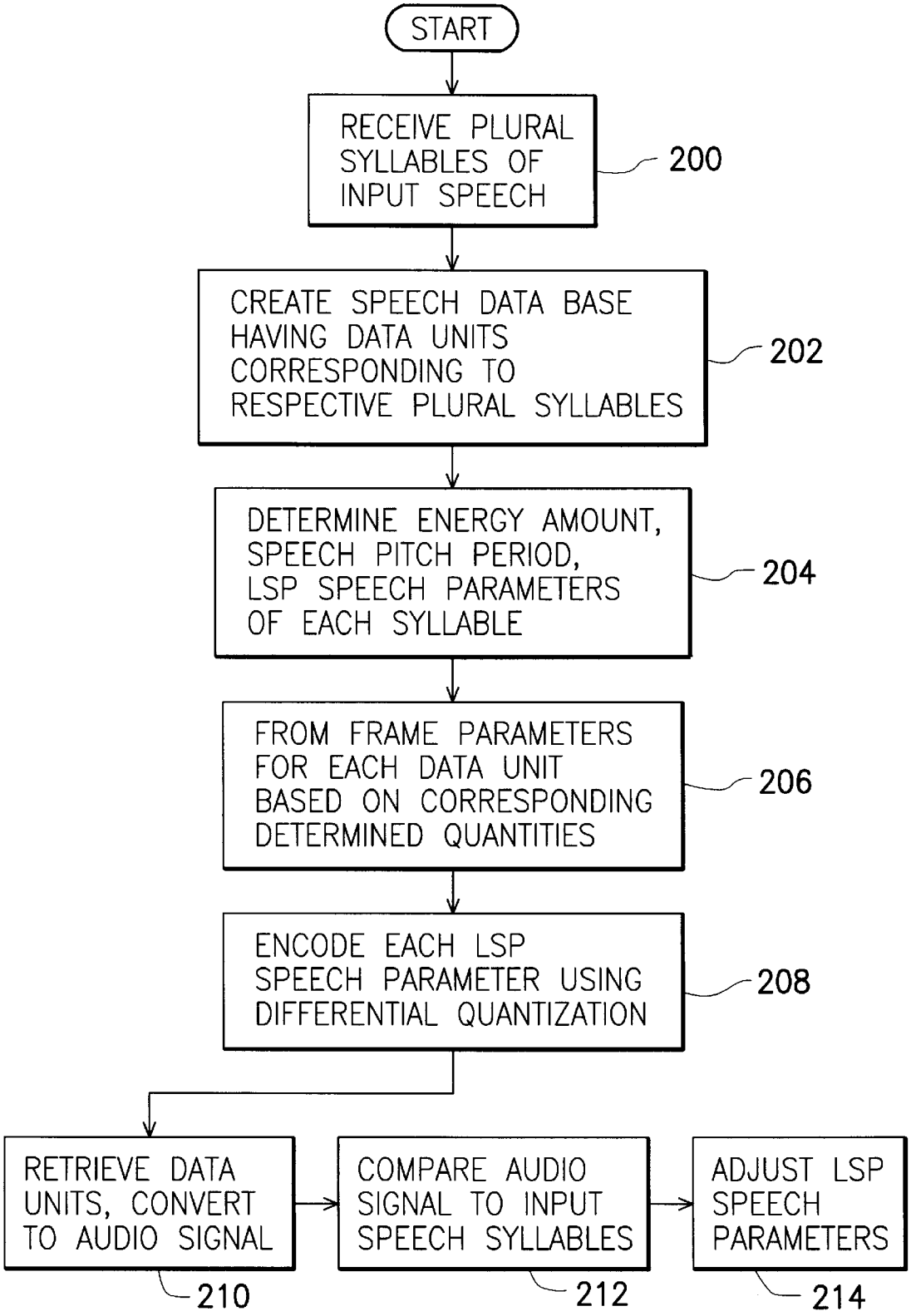
FIG. 2 shows steps for practicing the invention.
Figures 3, 4, 5, 6, 7, 8:
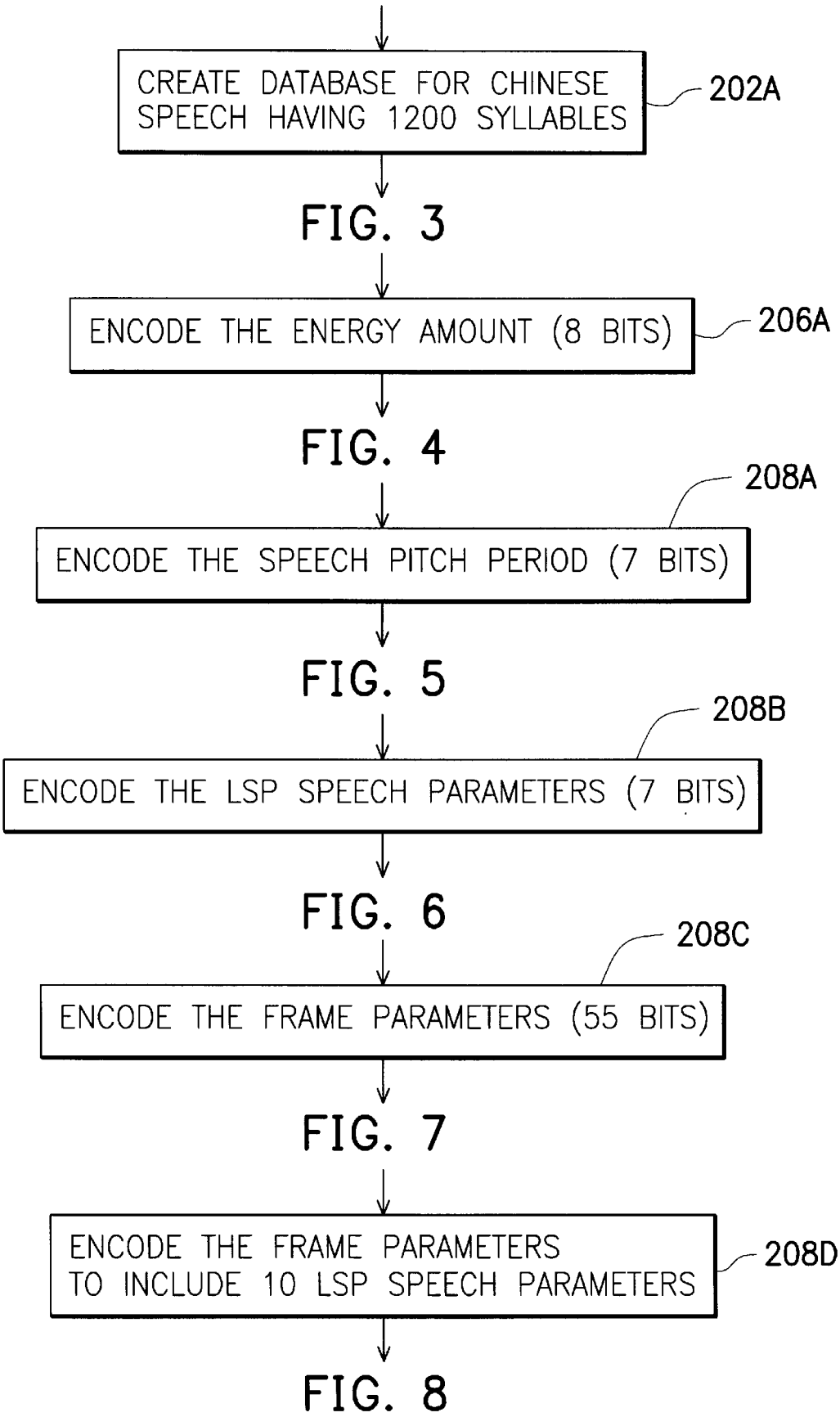
FIG. 3 shows a preferred embodiment of operation 202 of FIG. 2.
FIG. 4 shows a preferred embodiment of operation 206 of FIG. 2.
FIG. 5 shows a preferred embodiment of operation 208 of FIG. 2.
FIG. 6 shows a further preferred embodiment of operation 208 of FIG. 2.
FIG. 7 shows a further preferred embodiment of operation 208 of FIG. 2.
FIG. 8 shows a further preferred embodiment of operation 208 of FIG. 2.

Reference will now be made in detail to the present preferred embodiment of the invention, as is shown in FIG. 1.

In a Chinese speech data base 4 there are data units at least about 1200 received single-syllables 2. In accordance with the invention, 10-th order LSP speech parameters are used as the basic parameters of the speech data base, and a method which encodes the LSP parameters with 4-bit Differential Quantization is used. For example, each syllable includes the following parameters: a total frame number N of the syllable, parameters of the first frame, parameters of the second frame . . . , and parameters of the N-th frame. The parameters of each syllable are shown in Table 1.

Table 1

TABLE 1

| total frame number N | parameters of the first frame | parameters of the second frame | ... | parameters of the N-th frame |
|---|---|---|---|---|

Each frame is formed 6 to include: an energy amount, a speech pitch period, a first LSP parameter, a second LSP parameter . . . , and a 10-th LSP parameter. The energy amount is the output power of the frame and is encoded using 8 bits, and the speech pitch period is encoded using 7 bits. Because the LSP speech parameter is encoded 8 by the mathematical algorithm utilizing Differential Quantization, the LSP speech parameter is encoded using 4 bits. So, the total number of encoding bits for each frame is: 8+7+4(10)= 55 bits. The bit arrangement for a frame is shown in Table 2 below.

Table 2

TABLE 2

| energy amount | speed pitch period | first LSP parameter | second LSP parameter | . . . | 10-th LSP parameter |
|---|---|---|---|---|---|
| 8 bits | 7 bits | 4 bits | 4 bits | . . . | 4 bits |

Each performing period of the frame is about 25 ms. That is to say, the operating rate is:

55 bits/25 ms=2.2 K bits/s

The parameters of each syllable are downloaded by software. Then, the parameters forming the syllable are adjusted by way of audio testing to improve the speech quality.

Upon comparing the stored speech data encoded by conventional PCM methods with the method of the present invention, the data amount encoded by the present invention is greatly reduced. The whole stored speech data base of the present invention is approximately 1 M bits for approximately 1200 single-syllable pronunciations. For the same speech quality, the data amount required by the present invention is about 1/20 of that required by conventional methods.

In summary, and with reference to FIGS. 2–8, according to the method of the invention, input speech, including plural syllables, is received 200. A speech data base is created 202, wherein the speech data base includes plural data units that each represent corresponding ones of the plural syllables. Each of the plural data units has a total frame number and plural frame parameters. Each of the plural frame parameters is formed 206 to include an energy amount, a speech pitch period, and plural LSP speech parameters, based on the plural syllables of the input speech 204. Each of the plural LSP speech parameters is encoded 208 using differential quantization. At least some of the plural data units are retrieved 210 for conversion to corresponding audio signals, the audio signals are compared 212 to corresponding ones of the plural syllables of the input speech, and the LSP speech parameters are adjusted 214 based on a result of the comparison. Preferably, creating a speech data base 202 includes creating a data base having data units representing at least 1200 Chinese single syllables 202A. Preferably, forming each of the plural frame parameters 206 includes encoding the energy amount using 8 bits 206A. Preferably, encoding each of the plural LSP speech parameters 208 includes encoding each of the LSP speech parameters using 4 bits 208A, encoding the speech pitch period using 7 bits 208B, encoding each of the frame parameters using 55 bits 208C, and/or encoding each of the frame parameters to include 10 LSP speech parameters 208D.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method of encoding synthetic speech, comprising the steps of:

receiving input speech including plural syllables;

creating a speech data base, wherein the speech data base comprises plural data units that each represent corresponding ones of the plural syllables, each of the plural data units having a total frame number and plural frame parameters;

forming each of the plural frame parameters to include an energy amount, a speech pitch period, and plural LSP speech parameters, based on the plural syllables of the input speech; and encoding each of the plural LSP speech parameters using Differential Quantization.

2. A method according to claim 1, wherein the speech data base creating step includes creating a data base having data units representing at least 1200 Chinese single syllables.

3. A method according to claim 1, wherein the forming step includes encoding the energy amount using 8 bits.

4. A method according to claim 1, wherein the encoding step includes encoding the speech pitch period using 7 bits.

5. A method according to claim 1, wherein the encoding step includes encoding each of the LSP speech parameters using 4 bits.

6. A method according to claim 1, wherein the encoding step includes encoding each of the frame parameters using 55 bits.

7. A method according to claim 1, wherein the encoding step includes encoding each of the frame parameters to include 10 LSP speech parameters.

8. A method according to claim 1, further including retrieving at least some of the plural data units for conversion to corresponding audio signals.

9. A method according to claim 8, further including comparing the audio signals to corresponding ones of the plural syllables of the input speech.

10. A method according to claim 9, ftrther including adjusting the LSP speech parameters based on a result of the comparison.

* * * * *